United States Patent [19]

Harmsma

[11] 4,073,151

[45] Feb. 14, 1978

[54] MINE ROOF SUPPORT ASSEMBLIES

[75] Inventor: Gunter Harmsma, Bergkamen-Overberge, Germany

[73] Assignee: Gewerkschaft Eisenhutte Westfalia, Lunen, Germany

[21] Appl. No.: 761,727

[22] Filed: Jan. 24, 1977

[30] Foreign Application Priority Data

Feb. 5, 1976 Germany ..... 2604316

[51] Int. Cl.[2] ..... E21D 15/44

[52] U.S. Cl. ..... 61/45 D

[58] Field of Search ..... 61/45 D; 299/31-33; 91/170 MP; 248/357

[56] References Cited

FOREIGN PATENT DOCUMENTS

| | | | |
|---|---|---|---|
| 1,272,578 | 8/1961 | France | 61/45 D |
| 178,330 | 1/1966 | U.S.S.R. | 61/45 D |
| 1,213,019 | 11/1970 | United Kingdom | 61/45 D |
| 830,342 | 3/1960 | United Kingdom | 61/45 D |

*Primary Examiner*—Dennis L. Taylor

*Attorney, Agent, or Firm*—Thompson, Birch, Gauthier & Samuels

[57] ABSTRACT

A mine roof support assembly comprises a pair of adjacent mine roof support units and apparatus for guiding and aligning these units. Each of the units has a floor sill and telescopic props for bracing against the roof of a mine excavation. Shifting ram means are provided for displacing the units in the direction in which the working face advances. The guiding and aligning apparatus comprises two telescopic guide rods which are pivotally connected to the units. Each guide rod is constituted by a springless, non-hydraulic piston-and-cylinder device. The two guide rods are inclined at an acute angle to one another in such a way that, when the units are positioned side-by-side, one of the guide rods is completely retracted and its axis is perpendicular to the direction in which the units are displaced, and, when one of the units has been displaced by the shifting ram means relative to the other unit, the other guide rod is completely retracted.

8 Claims, 3 Drawing Figures

MINE ROOF SUPPORT ASSEMBLIES

BACKGROUND OF THE INVENTION

The invention relates to mine roof support assemblies and to guiding and aligning apparatus for the units of such an assembly.

When mine roof support units of the type having a floor sill and telescopic props for bracing against the roof of a mine excavation, are used in an excavation which dips, for example to follow a coal seam, steps have to be taken to prevent the units from slipping out of alignment and assuming an oblique position or tilting over when they are displaced in the direction of working face advance. For such purposes numerous guide and alignment devices are known, such as guide rail or guide rod systems with rigid guide rods or with hydraulic or mechanical telescopic guide rods. For example hydraulic telescopic guides may be interposed flexibly, and possibly on the universal joint principle, at a certain distance above the floor, between the props of adjacent units.

A guide system is also known in which the front and rear props of adjacent units are coupled via respective hydraulic telescopic guide rods, a diagonal hydraulic guide rod also connecting the rear prop of one unit with the front prop of the other unit. This guide rod system is constructionally expensive, as it requires, for all three telescopic guide rods, double-acting hydraulic piston-and-cylinder devices with appropriate hydraulic controls for controlling the retraction and extension of the devices during the shifting process. This guide rod system also necessitates using hydraulic piston-and-cylinder devices which have a long working stroke and which are, therefore, heavy, large and expensive; their length when retracted being equal to the distance between the props to which they are connected. This guide rod system involves the further drawback of seriously reducing the area available, between the props of the units.

Systems are also known in which spring biassed guide rods are provided between adjacent units. Apart from the comparatively high cost of such resilient guide rods, a guide rod system of this kind fails to ensure that the units will be adequately supported and guided by and aligned with one another, particularly in the event of any appreciable dip. This applies particularly when the guide rod system is to be used for guiding and aligning heavy units.

The main object of the invention is to provide a guiding and aligning apparatus for heavy mine roof support units which is simple, constructionally economical and of space-saving design.

SUMMARY OF THE INVENTION

The present invention provides apparatus for guiding and aligning a pair of adjacent units of a mine roof support assembly, the units each comprising a floor sill and a roof cap interconnected by telescopic props, the units being displaceable by shifting ram means, the apparatus comprising two telescopic guide rods which are pivotally connected, by joints, to the units, wherein each guide rod is constituted by a springless, non-hydraulic piston-and-cylinder device, and wherein the guide rods are inclined to one another at an acute angle whereby, when the units are positioned side-by-side, one of the guide rods is completely retracted with its axis perpendicular to the direction in which the units are to be displaced and, when one of the units has been displaced by the shifting ram means relative to the other unit, the other guide rod is completely retracted.

Preferably, the joints are provided on the floor sills of the units. Alternatively, the joints could be provided on the roof caps. This enables comparatively short telescopic guide rods to be used whose length, when completely retracted, is no greater (and may be considerably smaller) than the working stroke of the shifting ram means. Consequently, the available area between the props of the units is not appreciably reduced by this apparatus.

Advantageously, the joints are situated at the rear portions of the units and a beam is coupled to the front portions of the units, the beam extending, in use, along the working face of the mine excavation. Also, it is preferable if the joints of one of the units are both located forwardly of a rear telescopic prop of said one unit, and the joints of the other unit are located one on either side of a rear telescopic prop of said other unit. This provides a particularly good space-saving arrangement.

According to another aspect of the invention, apparatus for guiding and aligning three adjacent units of a mine roof support assembly the units each comprising a floor sill and a roof cap interconnected by telescopic props, the units being displaceable by shifting ram means, the apparatus comprising first and second pairs of telescopic guide rods, the first pair of guide rods being pivotally connected, by joints, to the units of one pair of adjacent units, and the second pair of guide rods being pivotally connected by joints, to the units of the other pair of adjacent units, wherein each guide rod of the first pair of guide rods is constituted by a springless, non-hydraulic piston-and-cylinder device and a first of the guide rods of the second pair of guide rods is constituted by a springless, non-hydraulic piston-and-cylinder device and the second guide rod of the second pair of guide rods is constituted by a double-acting hydraulic piston-and-cylinder device, and wherein the guide rods of each pair are inclined to one another at an acute angle, whereby, when the units of a given pair of units are positioned side-by-side, one of the guide rods of the associated pair of guide rods is completely retracted with its axis perpendicular to the direction in which the units are to be displaced and, when one of the units of that pair of units has been displaced by the shifting ram means relative to the other unit of that pair of units, the other guide rod of the associated pair of guide rods is completely retracted.

Each of the joints may be a universal joint which is preferably constructed as to be vertically adjustable. This enables the units to have sufficient freedom of movement to adapt themselves to any unevenness in the floor of the excavation.

BRIEF DESCRIPTION OF THE DRAWINGS

One form of mine roof support assembly including guide and alignment apparatus constructed in accordance with the invention will now be described, by way of example, with reference to the accompanying drawings, in which.

DESCRIPTION OF PREFERRED EMBODIMENT

Figure 1:
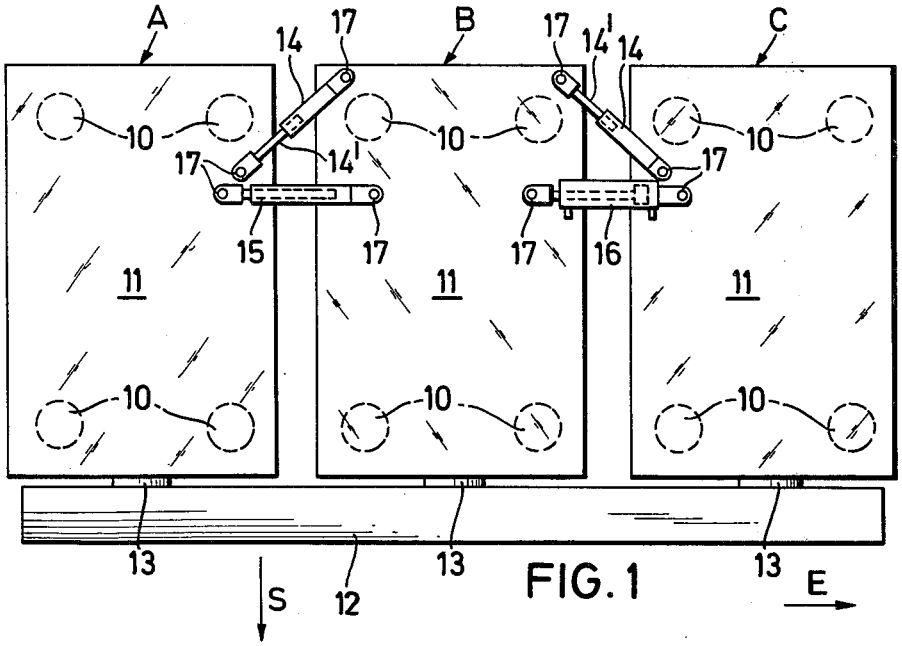
FIG. 1 is a plan view of the assembly showing three support units coupled together, the units being in a first configuration.

Referring to the drawings, FIG. 1 shows three support units A, B, and C, each of which has four hydraulic props 10 arranged at the corners of a rectangle. The feet of these props 10 are connected, in known manner, by universal-type joints to a respective floor sill 11 and, by ball joints, to a respective roof cap (not shown). Each floor sill 11 and each roof cap may be of single-part or multi-part construction. The units A, B, and C may, therefore, be support chocks or support frames.

The three units A, B, and C are coupled at their fronts, that is to say in their regions closest to the working face (not shown) of the mine excavation, by means of a beam 12 which extends along the working face. The beam 12 may form part of a displaceable working face conveyor which is situated adjacent to the working face. In this case, the units A, B, and C are coupled, in known manner, to the conveyor and, via guides 13, to shifting rams (not shown) for shifting the units in the direction S in which the working face advances. Alternatively, the beam 12 may be rigidly attached, as a lateral overhanging arm, to the front of the floor sill 11 of the middle unit B. In this case, only the outer units A and C are connected to the beam 12 by respective guides 13 and shifting rams.

The units A and B are also connected, in the regions remote from the beam 12 (i.e. on the goaf or stowage side), by means of two telescopic guide rods 14 and 15. Similarly the units B and C are also connected, on their goaf sides, by means of two telescopic guide rods 14 and 16. The two guide rods 14 and the guide rod 15 are all of identical construction and each consists of a simple, springless, piston-rod-and-cylinder device, the piston rods 14' and 15' of which are freely displaceable within the corresponding cylinders. The guide rod 16 is a double-acting hydraulic piston-and-cylinder device which can be extended and retracted by subjecting it to hydraulic pressure. The reference numbers 17 indicate the pivotable joints connecting the ends of the four guide rods 14,15 and 16 to the floor sills 11 of the units A, B and C.

The operation of shifting the units A, B and C in the direction S (see FIG. 1) of advance of the working face will now be described. By way of example, it is assumed that the working face dips in the direction of the arrow E shown in FIG. 1. FIG. 1 shows the three units A, B and C in their basic position prior to the shifting operation, in which all three units are spaced from the beam 12 by the same distance, and are parallel to one another. In this position, the guide rods 15 and 16 are fully retracted, these rods being so located between each pair of adjacent units A, B and B, C, that their longitudinal axes are parallel to the direction of dip E and perpendicular to the direction S of the working face advance. The other guide rods 14 are situated, in a plane substantially parallel to that of the floor of the excavation, each being at an acute angle with respect to its associated guide rod 15 or 16, and each being fully extended in the FIG. 1 position. The guide rods 14 and 15 only transmit forces acting in the direction E when they are completely retracted, that is to say when their piston rods 14' and 15' strike a stop at the ends of their travels within their respective cylinders.

Figure 2:
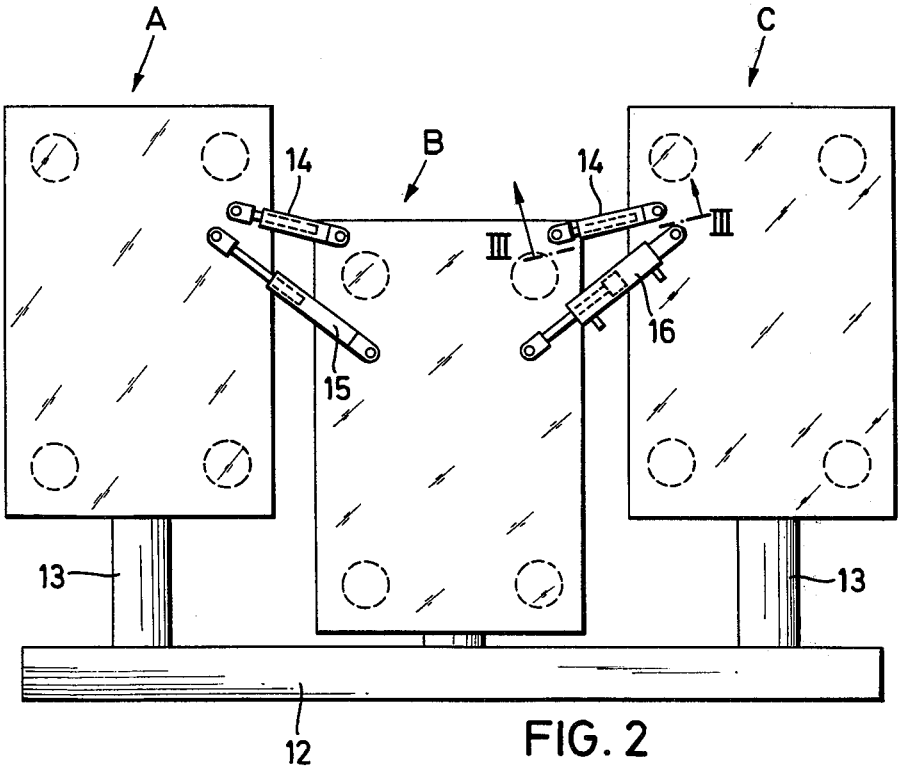
FIG. 2 is a plan view of the assembly showing the three support units in a second configuration.

If the hydraulic props 10 of the middle unit B are now relieved of their load and retracted so that this unit can be shifted in the direction S, this middle unit is supported at its rear (the goaf side) by the hydraulic guide rod 16. This prevents the unit B from slipping out of place into an oblique position. At this stage, none of the other guide rods 14 and 15 transmit any forces. In front, the unit B is supported by the beam 12 which in turn is held in position by the outer units A and C which are still braced between the floor and the ceiling of the excavation by their props 10. The unit B is then shifted, together with the beam 12, in the direction S by means of the shifting rams associated with the units A and C. During this shifting step, the four guide rods 14,15 and 16 pivot about their joints 17 from the positions shown in FIG. 1 to the positions shown in FIG. 2, so that the guide rods 14 retract whilst the guide rods 15 and 16 extend. In the position shown in FIG. 2, the unit B is supported, at the rear, by the fully retracted guide rod 14 against the unit C which lies "downstream" of it in the direction E in which the working face dips. This ensures that the unit B is, at all times before, during and after the shifting process, situated at the same lateral distance from each of the units A and C. If necessary, during the shifting process, the unit B can be supported against the unit C by subjecting the guide rod 16 to an increase in hydraulic pressure on that side thereof tending to extend that rod.

The unit B is then braced between the floor and ceiling of the excavation by extending its props 10. The outer units A and C can then be shifted, either in succession or simultaneously. Prior to this process, the outer units A and C are relieved of their loads by retracting their props 10. At the start of the shifting process, the unit A is supported against the braced unit B by means of the fully retracted guide rod 14, whilst at the end of this process it is supported by the now fully retracted guide rod 15. The unit C which is situated "downstream" of the unit B (as viewed in the direction E), is held at its rear by the hydraulic guide rod 16 during the shifting process, the guide rod 16 being subjected to an increase in hydraulic pressure on that side thereof tending to retract that rod. This prevents the unit C from slipping out of alignment and assuming an oblique position.

It will be apparent that the guide rod system described above enables the units A, B and C to be guided accurately and to be aligned and supported in the lateral direction. The system enables use to be made of short-stroke (and thus physically small) telescopic guide rods 14,15 and 16, which do not appreciably reduce the area available between the props 10 of the units A, B and C. The pivotable joints 17 of the guide rods 14,15 and 16 are positioned on the middle unit B in such a way that the joints of the rear guide rods 14 are situated on the goaf side behind the props 10 of the middle unit, while the joints of the other guide rods 15 and 16 are situated in front of these props. The distance between the joints 17 of each pair of guide rods 14,15 and 14,16 on the middle unit B, as viewed in the direction of travel S, is greater than the distance between the joints 17 of these pairs of guide rods on the outer units A and C. This distance between the joints 17 on the middle unit B, however, is considerably smaller than the distance between the props 10 of the units in the direction of travel S. The said distances are preferably equal to, or are smaller than, the travelling stroke of the shifting rams. The joints 17 of the pairs of guide rods on the outer units A and C are at a smaller distance apart in this direction, or they may even be combined in one single joint.

Figure 3:
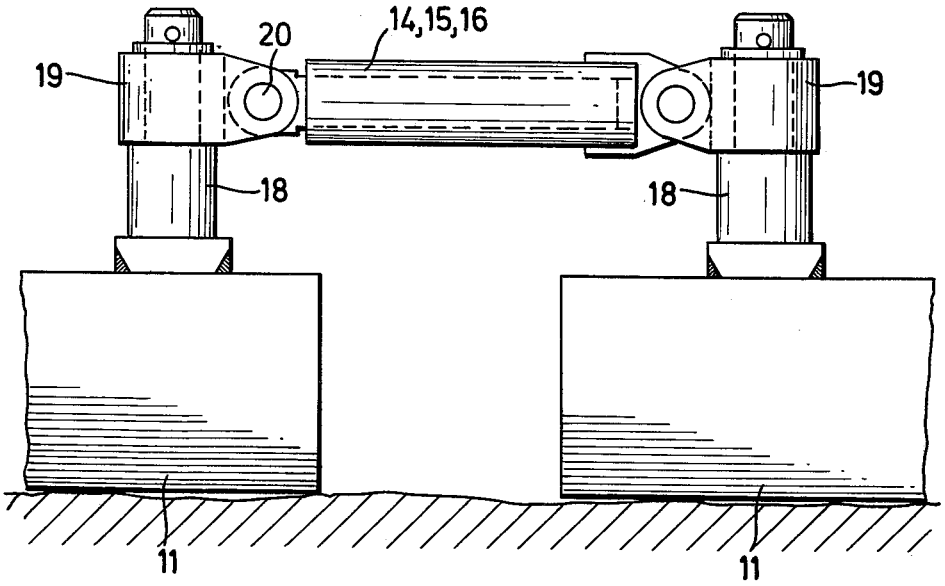
FIG. 3 is a cross-section taken on the line III—III of FIG. 2.

FIG. 3 shows a preferred embodiment of these joints 17 connecting the floor sills 11 of adjacent units. The floor sills 11 are fitted with vertical stay bolts 18 which bear cylindrical rotary sleeves 19 rotatably mounted about the vertical axis of the stay bolts. The telescopic parts of the relevant guide rod 14,15 or 16, as the case may be, are connected to these rotary sleeves 19, via pivotable joints 20 whose pivoting axes are perpendicular to the vertical axis of the stay bolts 18, i.e. these axes lie in the direction of travel S. The connection of the guide rods 14,15 and 16 to the floor sills 11 is accordingly provided via universal joints. The system can be arranged in such a manner that the rotary sleeves 19 are displaceable on the stay bolts 18 in the vertical direction. This increases the adjustability of the floor sills 11 in relation to one another in the vertical direction.

Throughout this specification, the term "springless, non-hydraulic piston-and-cylinder device" should be taken to mean a piston-and-cylinder device of type which is not damped by either hydraulic or spring means, ie., the piston is free to move within the cylinder apart from such restraining forces as frictional forces.

I claim:

1. Apparatus for guiding and aligning three adjacent units of a mine roof support assembly, the units each comprising a floor sill and a roof cap interconnected by telescopic props, the units being displaceable by shifting ram means, the apparatus comprising first and second pairs of telescopic guide rods, the first pair of guide rods being pivotally connected, by joints, to the units of one pair of adjacent units, and the second pair of guide rods being pivotally connected, by joints, to the units of the other pair of adjacent units, wherein each guide rod of the first pair of guide rods is constituted by a springless, non-hydraulic piston-and-cylinder device and a first of the guide rods of the second pair of guide rods is constituted by a springless, non-hydraulic piston-and-cylinder device and the second guide rod of the second pair of guide rods is constituted by a double-acting hydraulic piston-and-cylinder device, and wherein the guide rods of each pair are inclined to one another at an acute angle and arranged so that the guide rods interconnecting a given pair of units are alternately retracted and extended by alternate displacement of the units of said given pair, with one of the guide rods interconnecting said given pair being completely retracted with its axis perpendicular to the direction of unit displacement when the units are arranged in a side-by-side relationship.

2. Apparatus according to claim 1, wherein for each adjacent pair of units, the distance between the joints at the ends of the two guide rods which are wider apart, is not greater than the working stroke of the shifting ram means.

3. Apparatus according to claim 1, wherein the joints are situated at the rear portions of the units and a beam is fixed to the front portion of the middle unit, the two outer units being coupled to the beam by the shifting ram means, the beam extending, in use, along the working face of the mine excavation.

4. Apparatus according to claim 3, wherein an overhanging arm constitutes the beam.

5. Apparatus according to claim 1, wherein the joints of each of the outer units are both located forwardly of rear telescopic props of said outer units, and the two pairs of joints of the middle unit are located with one joint of each pair on either side of respective rear telescopic props of said middle unit.

6. Apparatus according to claim 1, wherein each of the joints is a universal joint.

7. Apparatus according to claim 1, wherein said one guide rod of said second pair of guide rods is the second guide rod of that pair.

8. A mine roof support assembly comprising three adjacent mine roof support units and apparatus for guiding and aligning said units, the units each comprising a floor sill and telescopic prop means for bracing against the roof of a mine excavation, the units being provided with shifting ram means for displacing the units, the guiding and aligning apparatus comprising first and second pairs of telescopic guide rods, the first pair of guide rods being pivotally connected, by joints, to the units of one pair of adjacent units, and the second pair of guide rods being pivotally connected by joints, to the units of the other pair of adjacent units, wherein each guide rod of the first pair of guide rods is constituted by a springless, non-hydraulic piston-and-cylinder device and a first of the guide rods of the second pair of guide rods is constituted by a springless non-hydraulic piston-and-cylinder device and the second guide rod of the second pair of guide rods is constituted by a double-acting hydraulic piston-and-cylinder device, and wherein the guide rods of each pair are inclined to one another at an acute angle, the guide rods being so arranged that, when the units of a given pair of adjacent units are positioned side-by-side, one of the guide rods of the associated pair of guide rods is completely retracted with its axis perpendicular to the direction in which the units are to be displaced and, when one of the units of that pair of units has been displaced by the shifting ram means relative to the other unit of that pair of units, the other guide rod of the associated pair of guide rods is completely retracted.

* * * * *